United States Patent [19]

Hart

[11] 4,367,680

[45] Jan. 11, 1983

[54] STANDOFF MUNITION

[75] Inventor: William H. Hart, 85 Dudley Rd., Newton Center, Mass. 02159

[73] Assignee: William Howard Hart, Newton Center, Mass.

[21] Appl. No.: 320,288

[22] Filed: Oct. 31, 1963

[51] Int. Cl.[3] ..... F42B 25/02

[52] U.S. Cl. ..... 102/387; 102/397; 102/504

[58] Field of Search ..... 102/57, 56, 5, 7.4, 102/62, 73, 88, 386, 387, 397, 504

[56] References Cited

U.S. PATENT DOCUMENTS 2,941,750 6/1960 Smith et al. ..... 102/387 X

*Primary Examiner*—Peter A. Nelson

[57] ABSTRACT

The invention features use of a probe that is flexible until after the munition is projected, so that it may be folded up and compactly stored despite considerable length, but is fairly rigid as the munition descends toward earth, and cooperates with other mechanism to explode the munition when the end of the probe engages an obstruction such as the ground.

9 Claims, 9 Drawing Figures

STANDOFF MUNITION

This invention relates to a standoff munition, and more particularly an improved such munition with simple but reliable standoff firing mechanism.

It is a primary object of the present invention to provide a standoff munition, adapted to be projected alone by hand or weapon, or as one of a group particularly by weapon, in which standoff firing is achieved by simple, compact, inexpensive, mechanical mechanism with great reliability and regardless of wide variation in the angle of approach of the munition to the ground. It is a further object to provide such a munition which makes improved provision for safety against firing not only prior to being projected, but during flight (and prior to reaching the height above ground at which firing is predetermined), again by simple and reliable mechanical means. It is a further object to provide such a mechanism capable of meeting military specifications, including requirements thereof as to tests for out-of-line safety, jolt and jumble, shipping vibration, operational vibration, shipping shock, muzzle shock (acceleration and deceleration), storage temperature extremes, and salt spray, humidity, and fungus environments.

The invention features use of a probe that is flexible until after the munition is projected, so that it may be folded up and compactly stored despite considerable length, but is fairly rigid as the munition descends toward earth, and cooperates with other mechanism to explode the munition when the end of the probe engages an obstruction such as the ground.

Other objects, features, and advantages will appear from the following description of preferred embodiments thereof, taken in conjunction with the attached drawings thereof, in which.

Figure 1:
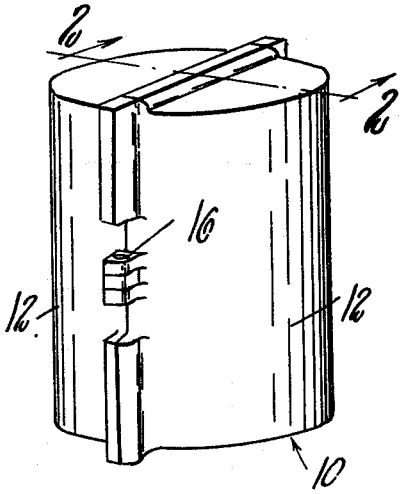
FIG. 1 is an isometric view of the presently preferred embodiment of the unprojected munition.

Referring now in more detail to the drawings, there is shown in FIG. 1 a standoff munition indicated generally at 10.

A pair of symmetrical cover elements 12 cooperate with generally rectangular O-ring (type in cross-section) gasket 14 to provide a sealed outer case, the elements 12 being held in position by a pair of shear pins 16, each extending through aligned holes in tongues protruding from the cover elements (the tongues and pin 180° opposite to those shown in FIG. 1 are not shown). The cover ribs 18 and 20 provide added strength.

Inside the outer case is a folded parachute 22 attached to cord 24 running over pulley 26 borne on shaft 28 journaled in walls 30 of the fuze container indicated generally at 32. Pivotally mounted on pin 34 also journaled in walls 30 is firing pin lever 36, through which extends cord 24, and which carries toward its inner end a generally downwardly extending firing pin 38. The firing pin lever includes a clevis portion 40 which carries, extending therebetween, pin 42 over which cord 24 passes between pulley 26 and the outer portions of the probe, indicated generally at 44 and defined by beads 46 strung on the cord 24.

Figure 2:
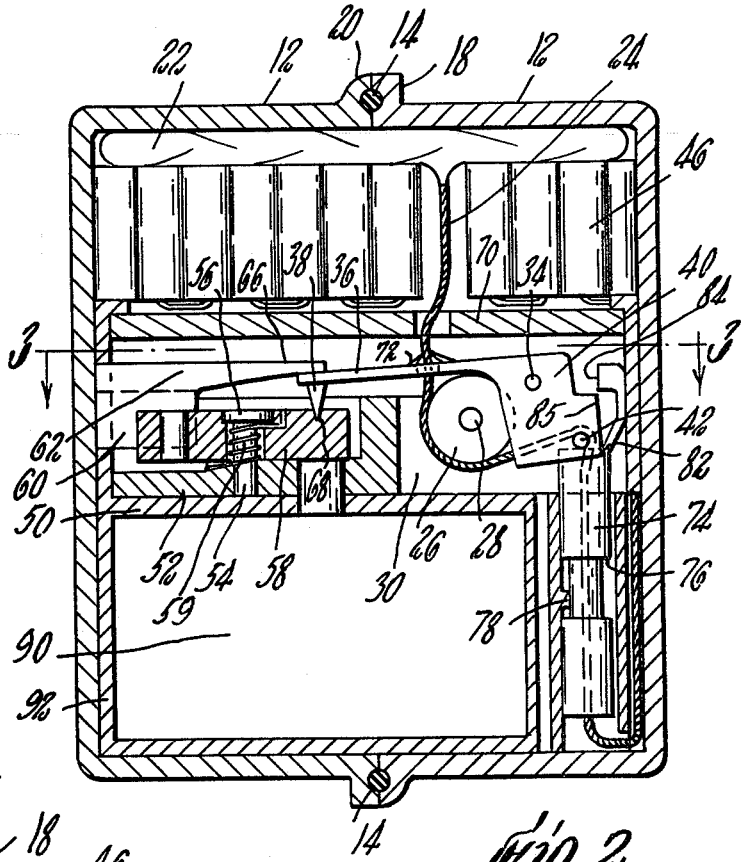
FIG. 2 is a vertical generally sectional view therethrough, taken at 2—2 of FIG. 1.
Figure 3:
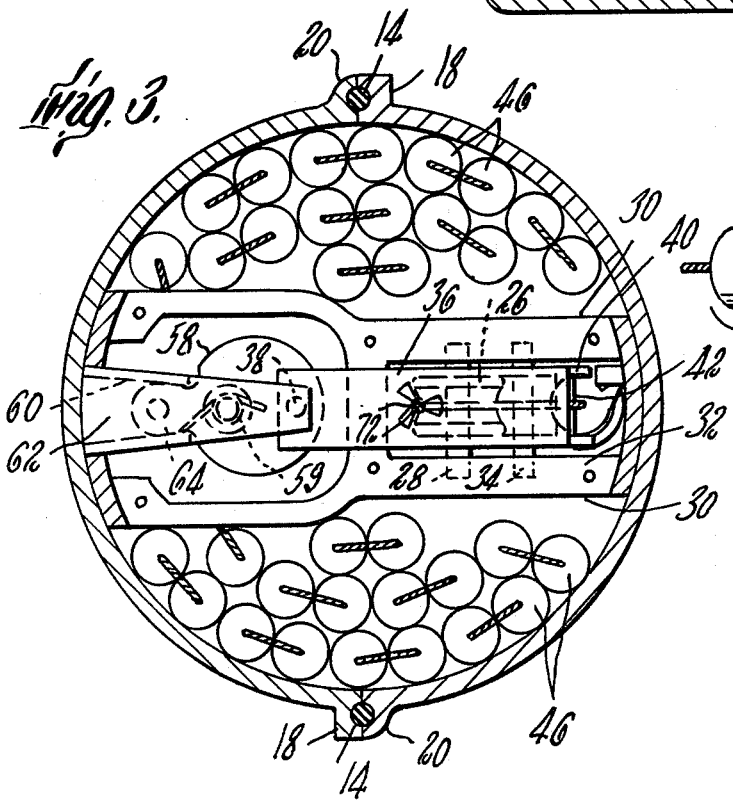
FIG. 3 is a sectional view taken at 3—3 of FIG. 2.
Figure 6:
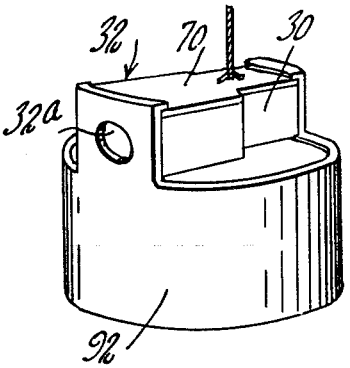
FIG. 6 is a partial isometric view detailing the configuration of the fuze and high explosive containers, cords and beads being shown in their falling-toward-earth relationship therewith.
Figure 5:
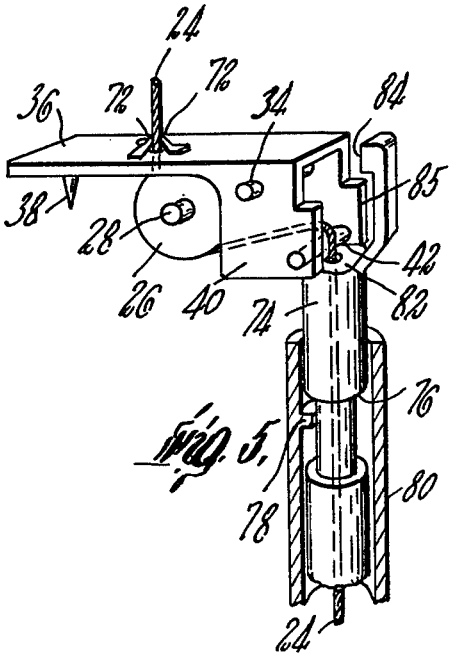
FIG. 5 is a partial isometric view detailing the firing pin lever and the manner in which the upper end of the probe cooperates therewith.
Figure 7:
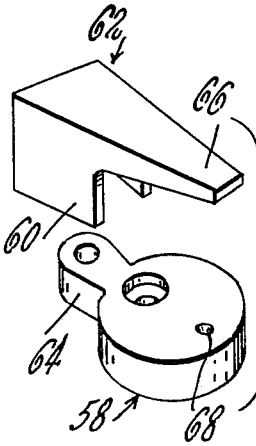
FIG. 7 is an exploded isometric view of the bore lock safety element and the detonator holder.

Seated on plate 50, which also defines the upper portion of the high explosive housing 92, is detonator holder support and booster carrier 52 which carries press fitted therein pin 54, which by virtue of head 56 secures detonator holder 58 down on support 52 for rotatably (about pin 54) slidable movement thereon. Spring 59 has ends which cooperate respectively with the support 52 and detonator holder 58 to urge the latter toward rotation about pin 54 relative to support 52. Prior to arming of the munition, as illustrated for example in FIGS. 2 and 6, this rotation is prohibited by clevis portion 60 of bore lock safety 62, which engages the sides of extension 64 of detonator holder 58. The inner tip 66 of the bore lock safety holds the firing pin 38 of the unarmed munition down in detent 68 of detonator holder 58.

Cord 24 extends from parachute 22 through a gap in a layer of beads 46, a hole in fuze cover plate 70, and a one-way opening defined by points 72 in firing pin lever 36, over pulley 26, pin 42, and then through member 74 and a multiplicity of beads 46. The cord is continuous, and all the beads in the munition are successively strung on it, but sufficient slack is left that in unarmed condition, the cord may be bent between the beads to permit folding up for storage of the beads above and alongside the fuze container defined by fuze cover plate 70 and side walls 30. The cord may suitably be provided at its end with knot 71 to prevent movement thereby of the lowest (in armed flight toward the ground) bead 46.

The member 74 has a shoulder 76 that cooperates with projection 78 of member case 80 to limit downward movement of the member 74. The member case 80 cooperates with the member 74 to provide for limited longitudinal movement of the latter, thus. In unarmed condition a second, upwardly directed shoulder 82 rests against the lower surface of pin 42. A third, and transversely, facing shoulder 84 of the member 74 is positioned to engage one lower edge 85 of firing pin lever 36 to hold it against rotation for safety should the member 74 move downwardly relative to the rest of the munition.

Figure 4:
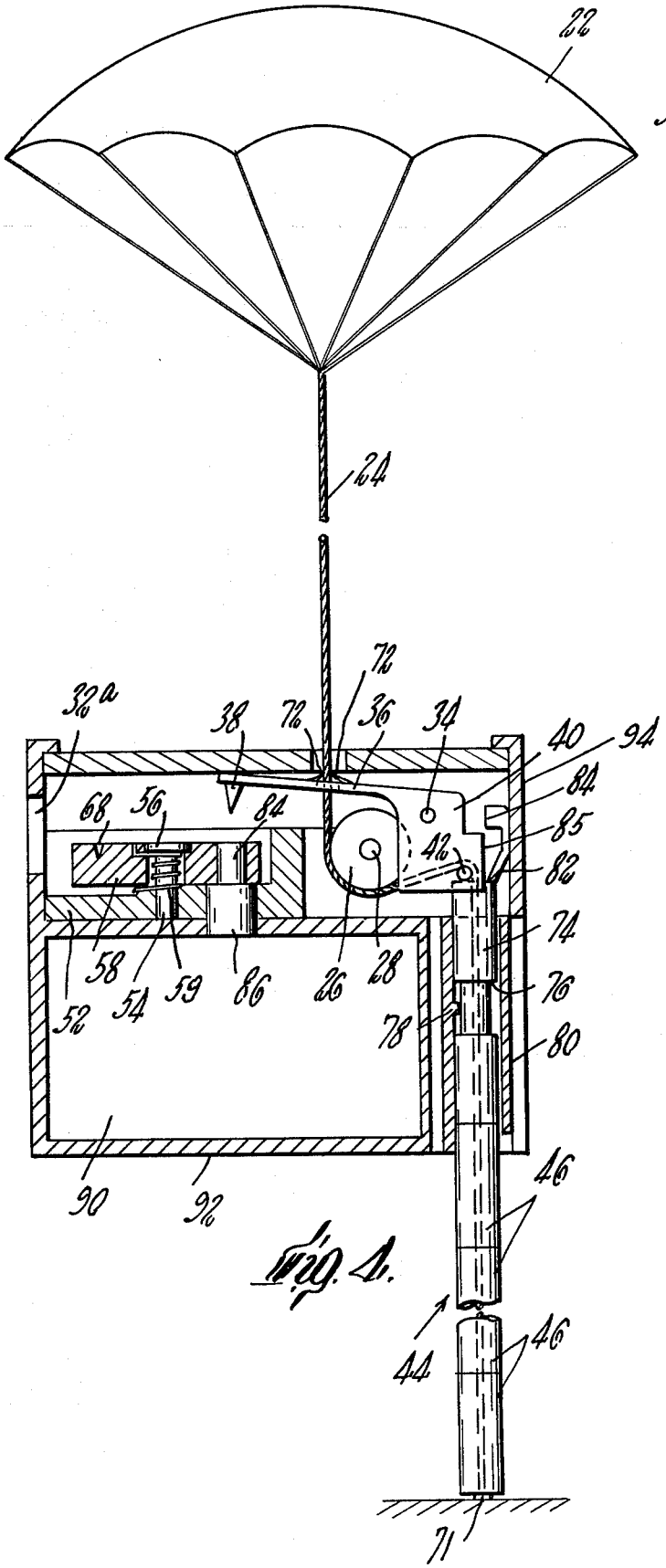
FIG. 4 is a view corresponding to FIG. 2, but showing the munition after projection and arming, and in mid-air approaching the ground.

In operation, the shear pins 16 are first sheared by centrifugal force in firing, for example as one of a group of munitions in a container opening in the air. (If the munition is projected by hand, the pins may be first pulled.) The cover elements 12 thereafter drop away from the rest of the munition. The parachute 22 then unfolds and catches the air, while the beads 46, previously confined by the cover elements, begin to drop. The bore lock safety 62 falls away through the hole 32*a*; it may if preferred be secured to one of the cover elements 12 to fall away therewith. By the time the drag of the parachute has taken all the slack out of the cord 24, as shown in FIG. 4, the beads have been pulled by it into a probe of some length, in the preferred embodiment much more than the greatest dimension of the unarmed munition, say for example 20 feet. Firing pin lever 36 is caused by the movement of cord 24 to rotate clockwise (as shown in FIG. 4) about pivot 34 until its inner tip is stopped by fuze cover plate 70. With removal of the bore lock safety and lifting of firing pin 38 from detent 68, detonator holder 58 rotates about pin 54 so that detonator 84 moves into position over booster 86, as shown in FIG. 4. The points 72 in firing pin lever 36 permit the cord 24 to move upwardly through the firing pin lever easily, as slack is taken out by the parachute's drag, but do not permit movement of the cord downwardly therethrough. (Other means to provide one-way movement, for example employing a ratchet, may suitably be used.)

Ordinarily, firing then occurs at the predetermined standoff position when the munition is a distance above the ground corresponding to the length of the semi-rigid column or probe 44. If the munition falls in such a way that the probe receives from the ground a force with a longitudinal component, the effect is to move the probe upwardly relative to the rest of the munition, with the consequences that the shoulder 82 of member 74 upwardly urges the outer end of firing pin lever 36, pivoting the same about shaft 34 to drive firing pin 38 into detonator 84, which fires through booster 86 high explosive 90 in high explosive container 92. If the probe 44 has impact at an angle, the longitudinal component pressing upwardly on the lower portion of the firing pin lever 36 is supplemented by a downward pull in cord 24 through the probe, produced by bending of the probe. This downward force, because the cord 24 cannot move downwardly through the points 72 in the firing pin lever 36, also urges the firing pin down into the detonator 84, tending to pivot the firing pin lever about shaft 34. If the probe strikes at an extreme angle, this firing mechanism may become controlling, and thus of especial importance. In the unlikely event the probe should fail to fire the munition, firing upon impact of the main body of the munition with the ground nevertheless occurs, inertia driving the firing pin 38 then into the detonator.

Firing in mid-air is ordinarily prevented by the tension put by the parachute 22 and the probe 44 of the cord 24, holding the firing pin 38 away from the detonator 84 through moments about pin 34. In the event a shock wave for example should tend to drive the main body of the munition upwardly relative to the probe in mid-air, however, the member 74 drops to interpose shoulder 84 between the firing pin lever 36 and the wall 94, the distance therebetween being just sufficient to accept the end of the member 74 carrying said shoulder, so that firing pin lever 36 is jammed against rotation for in-flight safety against accidental firing.

Figure 8:
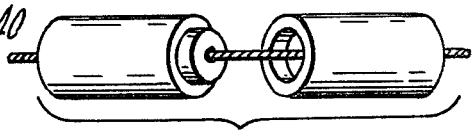
FIG. 8 is an isometric view of a modified bead useful in probes of munitions of the invention.
Figure 9:
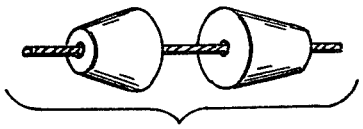
FIG. 9 is an isometric view of another modified bead so useful.

The bead of FIG. 8 may be used in a probe in which increased rigidity is wished, while the bead of FIG. 9, successive beads in the probe being oppositely longitudinally directed as indicated, may be used if increased response to bending of the probe is desired.

The art has been thus provided with a novel munition filling the objects above set forth. Other embodiments of the invention as claimed hereinafter will occur to those skilled in the art.

I claim:

1. A standoff munition comprising a removable outer case in which a pair of symmetrical cover elements with a gasket therebetween are held in place by at least one shear pin, an explosive container disposed within said case, a fuze container disposed within said case and on said explosive container, a multiplicity of elongated beads disposed in side-by-side relation above said fuze container and alongside said fuze container, a folded parachute disposed on said beads above said fuze container, a detonator holder, bore lock safety, firing pin lever, and pulley disposed in said fuze container, said beads, parachute, and bore lock safety being held against movement away from the rest of said munition only be said case and a stop resisting movement of the innermost bead, said detonator holder being pivotally mounted to bring a detonator therein beneath a firing pin carried by said firing pin lever upon withdrawal of said bore lock safety, said firing pin lever being pivotally mounted about an axis in said fuze container and carrying a cord-supporting pin on one side of said axis and being provided with a one-way hole on the other side of said axis, said pulley being rotatable about a second axis therebetween, said innermost bead extending upwardly into said fuze container and including a first shoulder for upwardly urging said cord-supporting pin, a second shoulder cooperating with a stop to limit movement away from the rest of said munition, and a third shoulder cooperating with an edge of said firing pin lever to jam the same against rotation in the event said innermost bead moves downwardly only slightly, and said cord, extending from said parachute down through said one-way hole, over said pulley, over said cord-supporting pin, through said innermost bead, and through the remainder of said beads successively.

2. The munition of claim 1 in which said firing mechanism is additionally actuated by impact of said explosive container.

3. A standoff munition comprising a perforated member housing, a plurality of perforated members in said housing, a flexible member passing successively through said perforated members, a removable arming element forming a portion of said housing and removable to permit said perforated members to fall downwardly, a dynamic arming element adapted to pull said flexible member through said perforated members to form the latter in longitudinally abutting relationship into a downwardly extending probe, and explosive firing mechanism actuated by impact of the lower tip of said probe, said probe being of length greater than the greatest dimension of said housing, said lower tip being rigidly spaced a predetermined distance beneath said firing mechanism, and said perforated members being disposed on said flexible member in said housing in spaced relationship to permit bending of said flexible member whereby all said perforated members may be accommodated within said housing.

4. The munition of claim 3 in which firing prior to probe tip impact is ordinarily prevented by the pull of said dynamic arming element on said flexible member and is prevented in the event of munition upward movement relative to said dynamic arming element by a mechanical shoulder moved into position to prevent actuation of said firing mechanism upon the introduction thus of slack in said flexible member.

5. The munition of claim 3 in which said actuation means includes a firing pin lever, said firing pin lever and said elongated flexible member cooperating to permit movement of the latter relative to the former in a direction to remove said slack only.

6. The munition of claim 3 in which said perforated members are beads having mating protruding and recessed portions for increased rigidity.

7. The munition of claim 3 in which said perforated members are beads having a greater area at one end than at the other, said beads being arranged in alternating longitudinal orientation.

8. A standoff munition comprising a removable outer case, air drag means adapted to produce greater air resistance than the remainder of said munition, an elongated flexible member secured to said air drag means, a multiplicity of beads strung successively on said flexible member, stop means to limit upward movement of said beads when pulled by said flexible member, and explosive train actuation means, said flexible member being of length to include slack between at least some of said beads, whereby said flexible member may be bent therebetween, said beads and air drag means being disposed inside said removable outer case and freed upon removal thereof, whereupon said beads fall free and said air drag means through said flexible member form a probe of said beads in falling through the air, said actuation means being responsive to both upward forces imposed by said beads of said probe and downward forces imposed by said elongated flexible member of said probe.

9. The munition of claim 8 in which said air drag means is a parachute.

* * * * *